US005857676A

United States Patent [19]

Whitson

[11] Patent Number: 5,857,676

[45] Date of Patent: Jan. 12, 1999

[54] APPARATUS AND METHOD OF PLAYING A COMBINATION CARD AND DICE GAME

[76] Inventor: Bryan J. Whitson, 1317 Miller, Cedar Hill, Tex. 75104

[21] Appl. No.: 797,175

[22] Filed: Feb. 10, 1997

[51] Int. Cl.[6] ..... A63F 1/00

[52] U.S. Cl. ..... 273/292; 273/274; 273/309

[58] Field of Search ..... 273/292, 274, 273/309, 146

[56] References Cited

U.S. PATENT DOCUMENTS 4,659,087 4/1987 Shen et al. ..... 273/274

5,397,128 3/1995 Hesse et al. ..... 273/292

*Primary Examiner*—Benjamin H. Layno

*Attorney, Agent, or Firm*—Martin Sachs

[57] ABSTRACT

A combination card and dice game requires all the skill of playing cards with the luck of the dice and includes a playing surface divided into a first plurality of generally pie shaped areas extending outwardly from a centrally disposed apex, with each of the first areas having indicia placed thereon indicating the type of wager being made by an individual utilizing said area. A second area disposed proximate the apex for rolling a pair of dice therein; a pair of dice; a deck of cards; and a plurality of chips having indicia thereon representing different values.

9 Claims, 3 Drawing Sheets

| ODDS OF SHOWING | CARDS | DICE ODDS OF SHOWING WIN ODDS | LOOSE ODDS | BET 100 | BET ON DICE ADVANTAGE | WINS 3 | BET ON CARDS ADVANTAGE | WINS 0.8 |
|---|---|---|---|---|---|---|---|---|
| | | | | | | 300 | | 80 |
| 0.076923 | ACE | 0.333333 | 0.666667 | | 33.33333 | | 20 | |
| 0.076923 | TWO | 0.361111 | 0.638889 | | 44.44444 | | 15 | |
| 0.076923 | THREE | 0.388889 | 0.611111 | | 55.55556 | | 10 | |
| 0.076923 | FOUR | 0.416667 | 0.583333 | | 66.66667 | | 5 | |
| 0.076923 | FIVE | 0.444444 | 0.555556 | | 77.77778 | | 0 | |
| 0.076923 | SIX | 0.472222 | 0.527778 | | 88.88889 | | −5 | |
| 0.076923 | SEVEN | 0.166667 | 0.833333 | | −33.3333 | | 50 | |
| 0.076923 | EIGHT | 0.138889 | 0.861111 | | −44.4444 | | 55 | |
| 0.076923 | NINE | 0.111111 | 0.888889 | | −55.5556 | | 60 | |
| 0.076923 | TEN | 0.083333 | 0.916667 | | −66.6667 | | 65 | |
| 0.076923 | JACK | 0.083333 | 0.916667 | | −66.6667 | | −100 | |
| 0.076923 | QUEEN | 0.083333 | 0.916667 | | −66.6667 | | −100 | |
| 0.076923 | KING | 0.083333 | 0.916667 | | −66.6667 | | −100 | |
| | | | | TOTALS | −33.3333 | | −25 | |
| | | | | ADVANTAGE CHECK | | −2.5641 | | −1.92308 |
| | | | | + PLAYER | 28.20513 | + PLAYER | 3.461538 | |
| | | | | + HOUSE | −30.7692 | +HOUSE | −5.38462 | |

OVER/UNDER SEVEN WAGER

| | | | | |
|---|---|---|---|---|
| ODDS FOR | 0.416667 | | | |
| ODDS AGAINST | 0.583333 | | | |
| PAYOUT | 1.4 | 1 | 1.2 | 1.4 |
| BET | $1.00 | EVEN | 6 TO 5 | 7 TO 5 |
| CASINO ADVANTAGE | | −16.67% | −8.33% | −0.00% |

ROYAL TRIFECTA WAGER

| | | | |
|---|---|---|---|
| ODDS FOR | 0.019231 | | |
| ODDS AGAINST | 0.980769 | | |
| PAYOUT | 25 | 40 | 50 |
| BET | $1.00 | | |
| CASINO ADVANTAGE | −0.5 | −0.21154 | −0.01923 |

ROYAL CRAPS WAGER

| | | | | | |
|---|---|---|---|---|---|
| ODDS FOR | 0.230769 | | | | |
| ODDS AGAINST | 0.769231 | | | | |
| PAYOUT | 1 | 1.5 | 2 | 3 | 4 |
| BET | $1.00 | 3 TO 2 | 2 TO 1 | 3 TO 1 | 4 TO 1 |
| CASINO ADVANTAGE | −53.85% | −42.31% | −30.77% | −7.69% | −15.38% |

FIG. 6

APPARATUS AND METHOD OF PLAYING A COMBINATION CARD AND DICE GAME

BACKGROUND OF THE INVENTION

1. Field of the Invention

The present invention relates generally to games of chance, and more particularly, to a combination of cards and dice providing for wagering on either the outcome of the dice relative to the target card or the target card.

2. Discussion of the Relevant Art

The art abounds with numerous types of card games, which include the use of one or more dice, however the one described and claimed herein is believed to novel.

SUMMARY OF THE INVENTION

The cards utilized herein are conventional and one or more decks thereof may be utilized to make it more difficult to determine what the next Target Card selected may be. The play of the game has no conclusion, but is limited only by the amount of money (chips) that the wagerer decides is his/her win or loss limit and the willingness of someone to take the position of the house, whose responsibility is to cover all wagers made by the players.

The present invention overcomes the shortcomings found in the prior art by providing a gambling game well suited to be used in legal gambling casinos which can run without stopping until closing time, as well as a parlor game wherein the player can set a limit of play based on time, amount won or lost, or rotation of which of the player takes the house position and covers all wagers.

Therefore, it is an object of the present invention to provide an exciting wagering game with the number of players being limited only by the number of players that can be placed about the areas or segments provided on the game playing surface.

It is another object of the present invention to provide a combination card and dice game that includes a playing surface divided into a first plurality of generally pie shaped areas or segments extending outwardly from a centrally disposed apex, with each area having indicia placed thereon indicating the type of wager being made by an individual utilizing that area. A second area disposed proximate the apex is used for rolling a pair of dice therein. A pair of dice, one or more decks of cards and a plurality of chips having indicia thereon representing different values are utilized to play the game.

The foregoing and other objects and advantages will appear in the description to follow. In the description reference is made to the accompanying drawings, which form a part hereof and in which is shown by way of illustration a preferred embodiment wherein the invention may be practiced. The preferred embodiment will be described in sufficient detail to enable those skilled in the art to practice the invention and it is to be understood that other embodiments may be utilized and that some changes may be made without departing from the spirit and scope of the present invention. The following detailed description is, therefore, not to be taken in a limiting sense, and the scope of the present invention is best defined by the appended claims. Like numerals have been used in the alternative embodiment for like areas to simplify the understanding of the invention.

BRIEF DESCRIPTION OF THE DRAWINGS

In order that the invention may be more fully understood, it will now be described by way of example, with reference to the accompanying drawings in which:

FIG. 6 is a table showing the ratio if card appearance and house percentages.

DESCRIPTION OF THE PREFERRED EMBODIMENT

Figures 1, 3, 4:
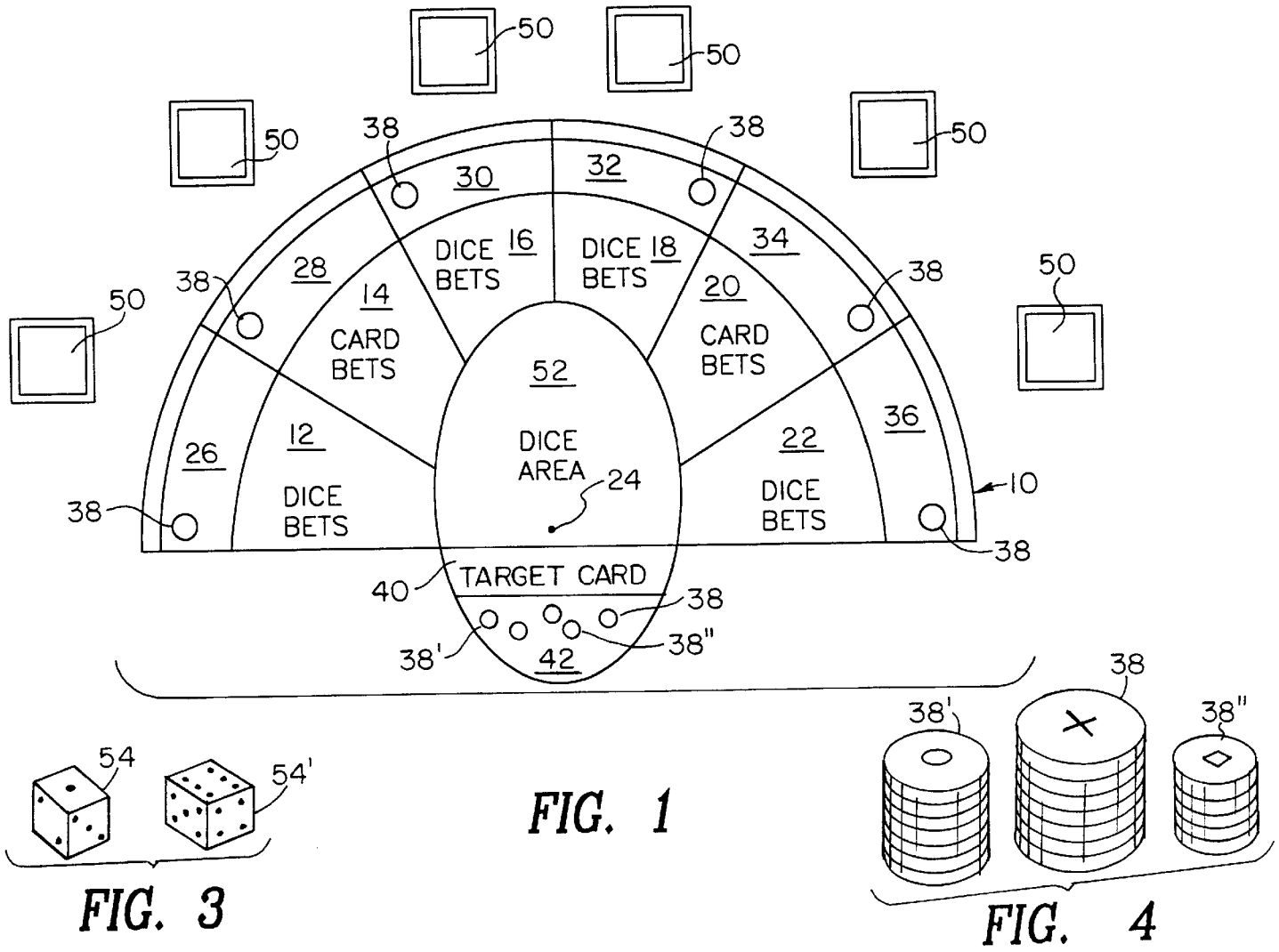
FIG. 1 is a top plan view of a typical playing surface upon which the game may be played, according to the principles of the present invention.
FIG. 3 is a pictorial representation of a pair of dice used in playing the game.
FIG. 4 is a pictorial representation of a plurality of chips or tokens of different values used in playing the game.

Referring now to the figures, and in particular to FIG. 1, there is a shown a typical playing surface 10 upon which the present game of chance, named ROYAL CRAPS™ by the inventor thereof, may be played. The playing surface 10 is divided into generally pie shaped areas 12, 14, 16, 18, 20 and 22, extending outwardly from a point or apex 24 disposed on surface 10. As shown four of the pie shaped areas 12, 16, 18, and 22 are relegated for dice bets and two 20 pie shaped areas 14 and 20 are relegated for card bets. The outer arcuate portions 26, 28, 30, 32, 34 and 36, disposed remote from said apex 24, is used for holding the wagerer's chips 38, 38' and 38" (FIG. 4) prior to their placing their bets, which will be explained hereinafter.

Figure 5:
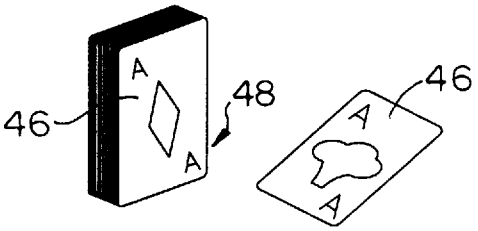
FIG. 5 is a pictorial representation of a deck of cards used in playing the game.

Areas 40 and 42, disposed proximate the apex 24, is utilized for the placing the target card 46 from the deck of cards 48 (FIG. 5) and holding the house chips 38, 38' and 38", respectively. Chairs 50 are placed about the playing surface 10 for the convenience of the players or wagers. Area 52, proximate the apex is set aside for the rolling of the dice 54 shown in FIG. 3.

Figure 2:
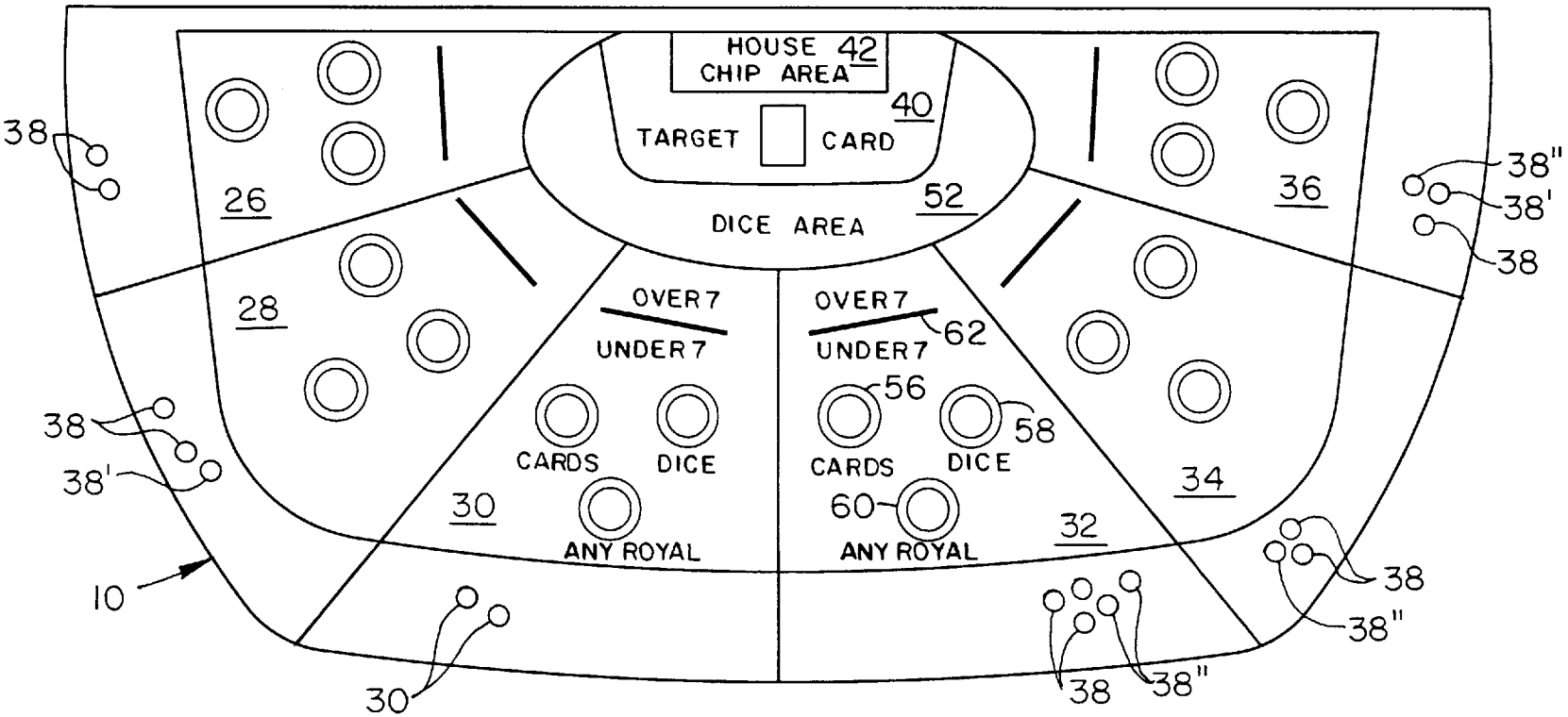
FIG. 2 is a top plan view of an alternative embodiment of a playing surface upon which the game may be played.

The alternative embodiment shown in FIG. 2 includes more details in the areas 26 through 36 by providing indicia therein (markings) upon which the wagerers places their bets as for example, indicia 56 is used when betting on the Cards, 58 when betting on the Dice, 60 when betting on Any Royal and 62 when betting Over/Under 7, all of which will be explained hereafter in conjunction with the explanation of the rules of the game.

RULES OF THE GAME

HOW TO PLAY ROYAL CRAPS™

ROYAL CRAPS™ is played with two dice 54 and at least one deck of fifty two playing cards 48 (as in Craps and Blackjack) and a playing surface 10. The more decks of cards that the game is played with the more random the outcome.

The player or wagerer chooses to either play the cards or play the dice. Once the decision is made, the dealer turns over one card (of course after they have been shuffled and cut). The card that is turned face up becomes the Target Card 46. As an example, assume that an "Ace" is turned face up. The dice are now rolled by the player with the highest bet on the dice, or by using the rotation method as in Craps.

If a "one" shows on either die 54 then the Target Card is hit, and the player(s) who bet on the dice win, of course the player(s) who bet on the cards lose.

A discussion of all the possible card targets will follow: Assume the dealer turns a "two" face up (the suit does not matter). The player or players who bet on the dice win if a "two" is rolled by either die or if snake eyes (one plus one=two) is thrown. There are three dice combinations for a winner. The player(s) that wagered (bet) on the cards loose. If any other combination is thrown on the dice, the player(s) that bet on the cards win.

Assume that the dealer turns a "three" face up. For the player wagering on the dice, a "three" appearing on either die or a 1, 2 or 2, 1 thrown makes the player betting on the dice a winner. Note that for this number there are four combinations of the dice that will make a winner. The player betting on the cards wins if any other dice combination is thrown.

If the dealer turns a "four" face up; then the player wagering on the dice needs a "four" on either of the die or a combination adding to "four" (1, 3: 3, 1 or 2, 2) to be a winner. There are five combinations for the player betting on the dice to be a winner. Again, the player betting on the cards wins if any other dice combination is thrown.

For a Target Card of "five" showing, the player(s) betting on the dice require a "five" on either die or a combination adding to "five" (1, 4: 4, 1: 2, 3: or 3, 2). Note, there are six combinations for a winner. The player(s) betting on the cards wins if any other combination is thrown on the dice.

If the dealer turns a Target Card of "six" face up, this presents the most combinations for the player betting on dice to obtain and therefor win. The players betting on the dice win if a "six" shows on either die or the combination adds op to "six" (1, 5: 5, 1: 2, 4: 4, 2: or 3, 3). Hence, there are seven ways to win. The player betting on the cards wins if the combination of the dice is not one of these combinations.

The Target Cards of "seven" through "ten" are made or reached by the dice bettors only by combinations of the dice. The possible combinations for the "seven" are adding the dice, e.g. (1, 6: 6, 1: 2, 5: 5, 2: 3, 4: and 4, 3). If these combinations are rolled then the players betting on the dice win and the players betting on the cards lose.

If the Target Card is an "eight" the combinations for the dice player to win are adding the dice, e.g. (2, 6: 6, 2: 3, 5: 5, 3: and 4, 4). The player(s) betting on the cards will win on any other combination.

If the Target Card showing is a "nine" the combinations for the dice player to win are adding the dice, e.g. (3, 6: 6, 3: 4, 5: and 5, 4). The player(s) betting on the cards wins on any other combination.

For the "ten" as the Target Card, the combinations for the dice player to win are adding the dice, e.g. (4, 6: 6, 4: and 5, 5). If the dice rolled is not one of these rolls, then the player betting on the cards wins.

If a face card is turned face up as the Target Card, then the card bettor(s) automatically lose. This is similar to the 2, 3 or 12 (called craps) on the come out (starting or first) roll in Craps. The dice bettor(s) must have an "eleven" or "twelve" (5, 6: 6, 5: 6, 6) rolled to be a winner. Hence, the face cards of Jack, Queen, and King are the royalty for Royal Craps.

WHAT ARE THE PAYOUTS

The payouts are as follows and are just suggestions of the inventor to make the game interesting for the players and interesting for the host gambling establishment (house). The players betting on the dice are paid 3 to 1, when they win and the players betting on the cards that win are paid four to five. This means that if two dollars are bet on the dice to win, they will be paid $6 if they win, and forfeit their $2 bet if they lose. If five dollars are bet on the cards to win, they will collect four dollars to win, and forfeit their $5 bet if they lose. It is obvious that it is harder for the dice to beat the cards, that is why the payouts are different for each of the bets. The house advantage for these and other payouts are listed in the table below.

| BET | PAY-OUT | ADVAN-TAGE | PAY-OUT | ADVAN-TAGE | PAY-OUT | ADVAN-TAGE |
|---|---|---|---|---|---|---|
| Dice | 3 to 2 | 39.103% | 2 to 1 | 26.923% | 3 to 1 | 2.565% |
| Card | 1 to 2 | 18.269% | 3 to 5 | 12.821% | 4 to 5 | 1.923% |

ANY ROYAL WAGER

This is a bet that the player may make before the Target Card is shown. The player is betting that a royal card (Jack, Queen, or King) will be the next Target Cards and places the wager in the appropriate location 60 on the playing surface 10 layout. The player wins if a royal card is the Target Card and losses if it is not the Target Card. The dealer should payout or take the wager after the decision so as not to cause confusion with the player's other wagers if any. The following table shows the house advantage for various payouts for this wager.

| Payout | Even Money | $3 to $2 | $2 to $1 | $3 to $1 |
|---|---|---|---|---|
| House Advantage | 53.85% | 42.31% | 30.77% | 7.68% |

This is a wager that the player could possibly increase the odds of winning if the player could accurately determine the remaining cards to be dealt. However, using multi-decks of cards, keeps the occurrence of royal cards random. By using a "$3 to $2" or "$2 to $1 " payback, allows the house and player a good chance at profit. This is because the player should only use this wager when he/she feels there is a good chance for a royal card as the Target Card.

"ROYAL CRAPS"—SIDE WAGERS OVER, UNDER OR EQUAL TO 7 WAGER

This is a wager that can have many variations. The essence of the wager is the player places a bet on whether the roll of the dice will be higher, lower or equal to seven. If the roll is a seven then both sides lose their bet. The variations are almost limitless such as being able to place this bet if the Target Card is a seven only or on all target cards and the payoffs could be from true odds to even money. Let's look at an example. A player bets that the dice total will be higher than seven. The dice total is eight and the player wins the bet along with the appropriate payoff depending on the house rules. If the dice total were seven or less than the player would lose the bet. Likewise, if the player bets that the dice total will be lower than seven, and the total is eight than the player would lose the bet. In order to win, the player needed the dice total to be six or less.

This bet is made by placing the wager in the designated place 62 on the table or playing surface 10. Example: The target card is seven and the player has a $10 bet on the dice to win. The player places $10 in the above seven area on the layout or playing surface 10. In this case, the payout is 6 to 5 for the over and under seven bet. If the dice total is "ten". The player loses the dice bet and wins the over seven bet and is paid $12 for the bet. Thus a net $2 gain for that Target Card.

Again, this wager can have many variations. Such as over/under seven bets can only be allowed, if there is a card or dice bet made and it can not exceed the amount of the card or dice bet. Or, the rules may allow the over/under seven bet to be wagered at any time and have no restrictions to the card or dice bet. Either method is acceptable with the inventor. The following shows the house advantage for various payouts for the over/under seven wager. For the benefit of the players and the house, a suggested payout is $6 to $5.

| Payout over/under 7 | Even Money | $6 to $5 | $7 to $5 |
|---|---|---|---|
| House Advantage | 16.67% | 8.33% | 0.00% |

| Payout Equals 7 | $5 to $1 | $4 to $1 | $3 to $1 |
|---|---|---|---|
| House Advantage | 0.00% | 16.67% | 33.33% |

ROYAL TRIFECTA WAGER

The royal trifecta is actually three separate wagers combining for another larger payout. The separate wagers are simultaneous bets on the Royal Craps, dice, and over seven wagers. Each of the bets must be of the same amount. For instance, the player places five dollar wagers on the Royal Craps, dice, and over seven totalling $15 in this case. For the royal trifecta to payout, each of these bets must win. If one of these bets do not win, then the appropriate payouts or lack thereof take place. If this combination of winning bets does take place, the payouts for each of the wagers are made plus an additional amount determined by the house based on the odds it wants to establish. A suggestion is to have the payout at 25 to 1 based on the amount of the over seven wager reminding that all wagers must of the same amount, or the royal trifecta could be paid using a progressive jackpot theory. The progressive jackpot is initially set by the house and is raised as the players play and do not hit this royal trifecta. Once a player hits the wager then it is reset back to the house's initial setting. The percentage of players hitting this royal trifecta are less than 2%. The following table shows some suggested payouts and the house advantage for each of the payouts.

| Payouts | 25 to 1 | 40 to 1 | 50 to 1 |
|---|---|---|---|
| House Advantage | 50% | 21.154% | 1.923% |

The above house advantage is based solely on the odds of winning the total bet and do not include the payouts on each the separate wagers. With the progressive jackpot theory, the house advantage changes as the jackpot changes.

GENERAL COMMENTS ABOUT ROYAL CRAPS

Where does the skill of cards come into play? If one could successfully count the number of cards shown, then with some accuracy the player could predict when to bet on the cards or switch to betting on the dice. This of course is easier with one deck as opposed to multiple decks.

If there are not any player(s) at the table betting on the dice, then the dealer may roll the dice to determine that outcome if the player(s) choose. The player with the highest bet on the dice has the first choice of rolling the dice. If this player declines to roll the dice, then the dice player who is clock-wise from the declining player has the option of rolling the dice and so on it goes until the dice are rolled.

The odds and the house advantages shown in the tables are the inventors best calculations. They are by no means implied to be the only way to play ROYAL CRAPS™. They are listed for the player's and house's guide to play the game.

In operation, the game may be played by setting a limit as to the amount of chips that may be purchased from the house, and the game ends when one or all of the player loose their chips or the game may run until there are no players or the house closes.

Hereinbefore has been disclosed a game of chance that combines the elements of playing cards together with the roll of the dice.

Having thus set forth the nature of the invention, what is claimed is:

1. A combination wagering card and dice game comprising:

A. a playing surface;

a) said playing surface being divided into a first plurality of generally pie shaped areas extending outwardly from a centrally disposed apex, b) each said first areas having, i) indicia placed thereon indicating a dice area, for indicating a wager on the dice totals, when chips are placed thereon and ii) indicia placed thereon indicating a card area for indicating a wager on the cards, when chips are placed thereon, by c) a second area disposed proximate said apex for rolling a pair of dice therein, the numerals appearing on the dice when rolled, being compared to a target card, to determine winners and losers, d) a third area in which a target card is placed, disposed proximate said second area and said apex;

B. a pair of dice, each die of said pair of dice having indicia on each face representing one of the numerals from 1 to 6 thereon;

C. at least one deck of cards having a plurality of cards therein with each card having a numerical value corresponding to numbers and sums of numbers appearing on said pair of dice; and D. a plurality of chips having indicia thereon representing different values, which are placed on said dice area or said card area to indicate a wager thereon.

2. A combination wagering card and dice game according to claim 1, further including a chip area disposed proximate said apex for placing said chips used by a house dealer.

3. A combination wagering card and dice game according to claim 1, further including indicia disposed in each said first area indicating the type of wager being placed thereon.

4. A combination wagering card and dice game according to claim 1, further including an area disposed remote from said apex for holding said chips of the wagerers prior to their placing their wagers.

5. The method of playing a wagering card and dice game known as "ROYAL CRAPS" comprising the steps of:

I. providing a playing surface;

a) said playing surface being divided into a first plurality of generally pie shaped areas extending outwardly from a centrally disposed apex, b) each said first areas having, i) indicia placed thereon indicating a dice area, for indicating a wager on the dice totals, when chips are placed thereon and ii) indicia placed thereon indicating a card area for indicating a wager on the cards, when chips are placed thereon, by an individual utilizing said area, c) a second area disposed proximate said apex for rolling a pair of dice therein, the numerals appearing on the dice when rolled, being compared to a target card, to determine winners and losers, d) a third area in which a target card is placed, disposed proximate said second area and said apex;

B. a pair of dice, each die of said pair of dice having indicia on each face representing one of the numerals from 1 to 6 thereon;

C. at least one deck of cards having a plurality of cards therein with each card having a numerical value corresponding to numbers and sums of numbers appearing on said pair of dice; and D. a plurality of chips having indicia thereon representing different values, which are placed on said dice area or said card area to indicate a wager thereon;

II. providing at least one player who elects to wager a sum on said dice and at least one player who elects to wager on said cards, each of said players placing their wagers of different amounts on the indicia within each one of said first areas disposed before each said player;

III. providing a house dealer who turns over one card, face up, known as the target card from the deck of cards after having shuffled them;

IV. rolling the dice by the player with the highest sum wagered on the dice or by taking turns by each dice wagerer;

V. declaring a winner and loser by the house dealer reviewing the numbers appearing on each die, the dice wagerer is declared a winner if the sum of the dice or if one of the die is the same as the number appearing on the target card, the card wagerer is declared the winner, if the sum of the dice or if one of the die is not the same as the number appearing on the target card then the card wagerer is declared the winner;

VI. paying the winner by the house dealer with house chips as determined by the ratios set forth in FIG. 6; and VII. continuing the game by repeating the steps as set forth in steps I through VI.

6. The method of playing a wagering card and dice game according to claim 5, further including betting on whether a picture card is turned face up as the target card wherein the player wagering on the cards is declared a looser and the dice wagerer must roll the dice with a sum of eleven or twelve to be declared a winner.

7. The method of playing a wagering card and dice game according to claim 5, further including a wagerer betting on whether a picture card is about to be turned face up as the target card, if the wagerer has chosen correctly he will be declared a winner.

8. The method of playing a wagering card and dice game according to claim 5, further including a wagerer betting on whether the roll of the dice will be over or under seven, being declared a winner if the dice rolled corresponds to the wager and loosing if the dice totals a seven.

9. The method of playing a wagering card and dice game according to claim 5, further including providing indicia on said playing surface in said first areas to indicate when said wagers set forth in claims 6, 7, and 8 are being made.

* * * * *